United States Patent [19]

Smith

[11] Patent Number: 4,477,136

[45] Date of Patent: Oct. 16, 1984

[54] TAKEOUT CONNECTOR

[75] Inventor: J. David Smith, Sugarland, Tex.

[73] Assignee: Mark Products Incorporated, Houston, Tex.

[21] Appl. No.: 437,688

[22] Filed: Oct. 29, 1982

[51] Int. Cl.[3] ..... H01R 25/00

[52] U.S. Cl. ..... 339/49 R; 339/218 M; 339/105; 339/94 M

[58] Field of Search ..... 339/47–49, 339/218 R, 218 M, 105, 184, 94 M, 191

[56] References Cited

U.S. PATENT DOCUMENTS

| | | | |
|---|---|---|---|
| 2,124,207 | 7/1938 | Neesen | 339/49 R |
| 2,199,219 | 4/1940 | Edwards et al. | 339/105 |
| 2,506,979 | 5/1950 | Varnum | 339/47 R |
| 2,726,374 | 12/1955 | Lipton | 339/105 |
| 3,092,430 | 6/1963 | Miller | 339/47 R |
| 3,489,987 | 1/1970 | Niskin | 339/47 R |
| 3,564,709 | 2/1971 | Hickton | 339/218 M |
| 3,638,164 | 1/1972 | Glance et al. | 339/49 R |
| 3,675,188 | 7/1972 | Startin et al. | 339/191 M |
| 3,693,132 | 9/1972 | Bowen et al. | 339/47 R |
| 4,059,329 | 11/1977 | Macemon | 339/218 R |
| 4,093,332 | 6/1978 | Simko | 339/49 R |

*Primary Examiner*—John McQuade
*Assistant Examiner*—David L. Pirlot
*Attorney, Agent, or Firm*—Vaden, Eickenroht, Thompson, Bednar & Jamison

[57] ABSTRACT

The invention disclosed includes a takeout connector having a body of elastomeric material with first and second protruding cylindrical portions. A male plug and a female socket in side-by-side relationship in each cylindrical portion. The second cylindrical portion has a cavity to receive a first cylindrical portion of another connector to allow the connector to be electrically connected to two similar connectors.

2 Claims, 5 Drawing Figures

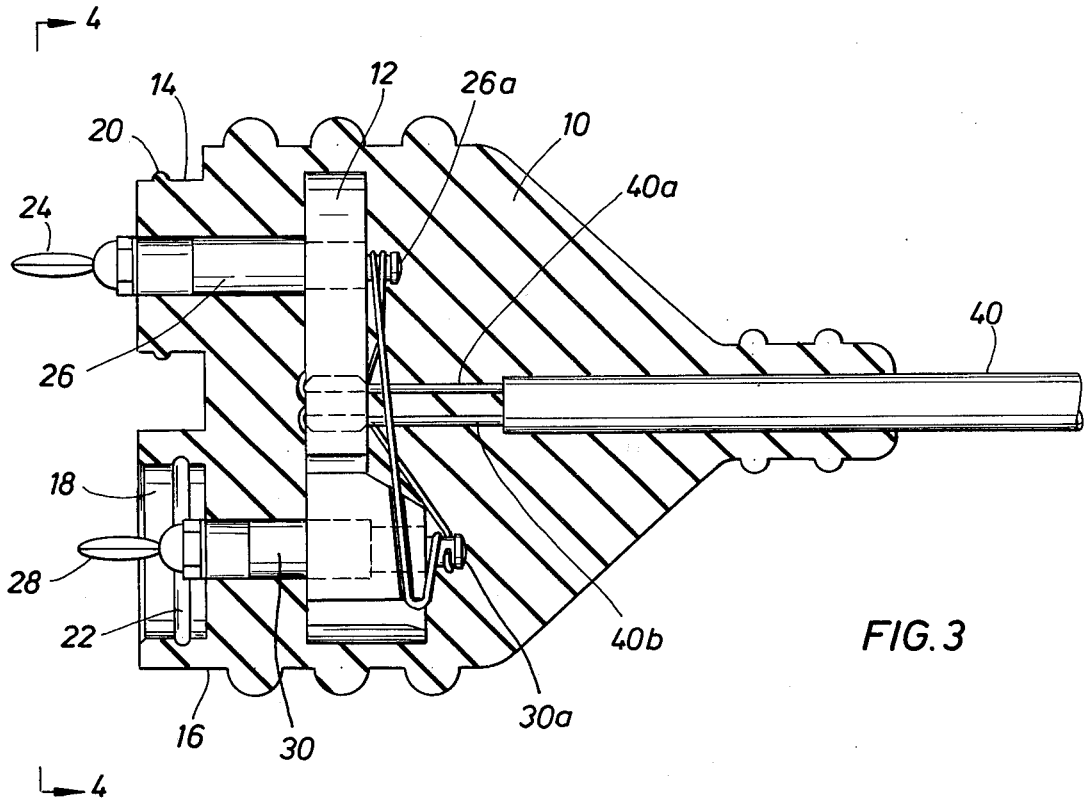
FIG. 3
FIG. 4
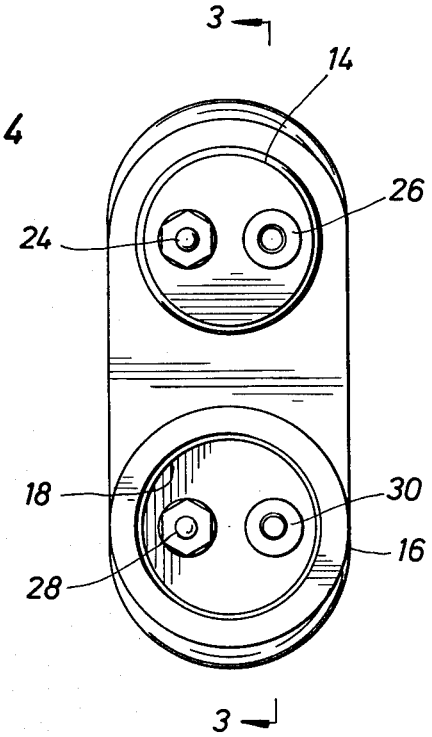
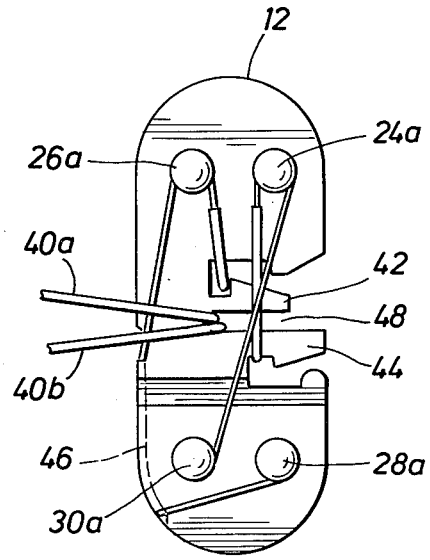
FIG. 5

TAKEOUT CONNECTOR

This invention relates generally, to an electrical cable connector, commonly called a "takeout connector", for connecting a plurality of strings of geophones to a main cable. In one aspect, the invention relates to such a connector for use in marshy areas and the like where the connector may often be in or under water.

When taking a seismic survey, a main cable having one end connected to the recording truck will extend outwardly from the truck for hundreds and even thousands of feet. Along the main cable, are a plurality of spaced takeout connectors that are intergrally connected in the cable. These are referred to as takeout connectors, but for the purpose of this specification, they will be referred to as main cable takeout connectors to distinguish them from the takeout connectors of this invention that connect the geophone strings to the main cable takeout connectors.

The takeout connector of this invention, is connected to a geophone string and is designed so a plurality of such connectors can be used to connect a plurality of geophone strings to one main line takeout connector. Such takeout connectors need to be designed so that they can be quickly and easily connected and disconnected. They should be shaped to offer a minimum of possibilities for hanging up on weeds and the like as they are drug from one position to another while connected together to move the geophones to another position. Further, since the drag of the geophones is transmitted through the takeout cable to the connector, the takeout cable should be connected to the connector in such a manner that this stress will not damage the connector or the takeout cable.

It is an object of this invention to provide such a takeout connector.

It is another object of this invention to provide such a connector for use in marshy and swampy terrain.

It is another object of this invention to provide a takeout connector having a unique shape such that, when a plurality of the takeout connectors are assembled, the connectors are in side-by-side relationship and form a compact structural unit that will jointly resist turning movement imposed on each individual connector.

These and other objects, advantages, and features of this invention will be apparent to those skilled in the art from a consideration of this specification, including the attached drawings and appended claims.

IN THE DRAWINGS:

FIG. 3 is a sectional view through the preferred embodiment of the takeout connector of this invention taken along line 3—3 of FIG. 4;

FIG. 4 is a view looking in the direction of the arrows 4—4 of FIG. 3; and

FIG. 5 is a view in elevation of the stress member of the takeout connector showing how the two conductors of the takeout cable are physically connected to the stress member and electrically connected to the male plugs and female sockets of the connector.

Figure 1:
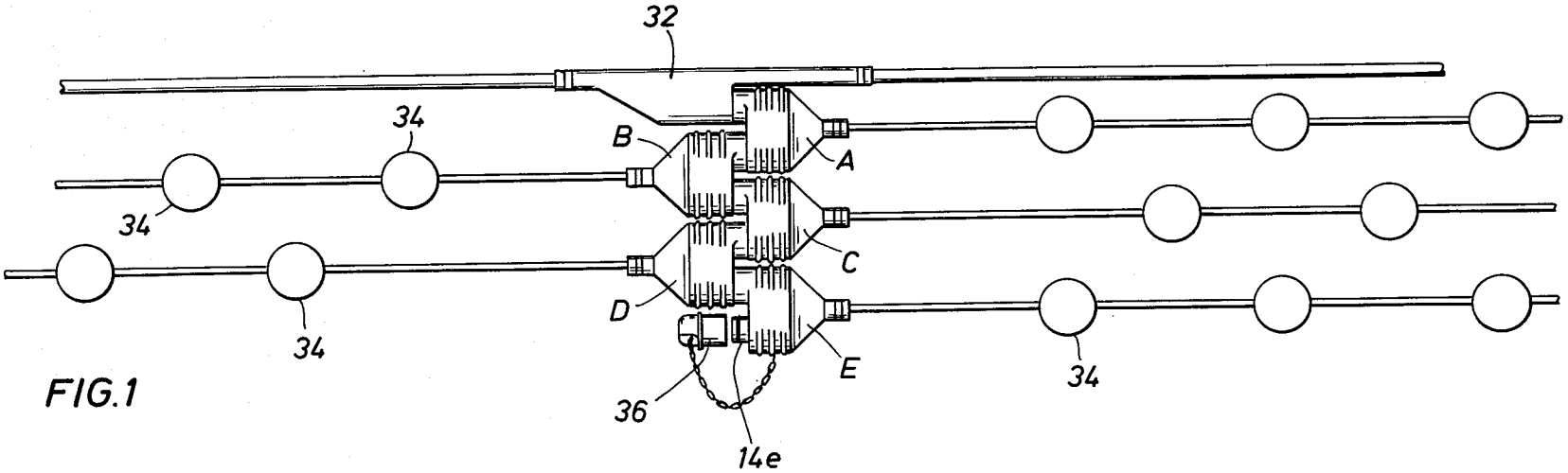
FIG. 1 is a plan view of five takeout connectors of this invention assembled to connect five strings of geophones to the main cable.

Before discussing the assembled connectors of FIG. 1 and FIG. 2, the structure of the takeout connector of this invention will be described as shown in FIGS. 3, 4, and 5.

The connector includes a molded body of elastomeric material 10 in which is embedded stress member 12. As shown in FIG. 3, the upper portion of stress member 12 is about half as thick as the lower portion. This is done for reasons that will be described below. The body of elastomeric material includes two protruding cylindrical portions 14 and 16, one of which, portion 16 in this embodiment having cavity 18 to receive the cylindrical portion 14 of another connector.

Means are carried by one of the portions to form a water tight seal with the other when a portion, such as cylindrical portion 14 of another connector, is inserted into cavity 18 of portion 16. In the embodiment shown, such means include annular member 20, which is hemispherically shaped in cross section. It is molded on the outer surface of cylindrical portion 14 to be received by annular groove 22 that is similar in cross section and is located on the inside wall of cavity 18 of cylindrical portion 16.

Male plug 24 and female socket 26 are mounted on the upper end of stress member 12 in side-by-side, spaced, relationship. The male plug and female socket are positioned in cylindrical member 14, as shown in FIGS. 3 and 4. In the same manner, male plug 28 and female socket 30 are mounted in the lower portion of stress member 12 and positioned in side-by-side relationship in cylindrical portion 16. The male plugs and female sockets in each of the cylindrical portions are positioned along spaced parallel planes, as shown in FIG. 4. This allows the connectors to be connected, as shown in FIGS. 1 and 2. For example, in FIG. 2, cylindrical member **16*a* of connector A is positioned to be moved over cylindrical portion 31 on main cable takeout connector 32. Cylindrical portion 31 is provided with a male plug and a female socket arranged in the same manner as they are arranged in cylindrical portion 14 of the connector of FIG. 3 so that the male plug will enter the female socket in cylindrical portion 16*a* and vice versa. Cylindrical portion 14*a* of connector A can then be connected to cylindrical portion 16*b* of connector B, cylindrical portion 14*b* of connector B can be connected to cylindrical portion 16*c* of connector C, and so forth, until as many strings of geophones as desired are electrically connected to the main line takeout connector 32**.

Figure 2:
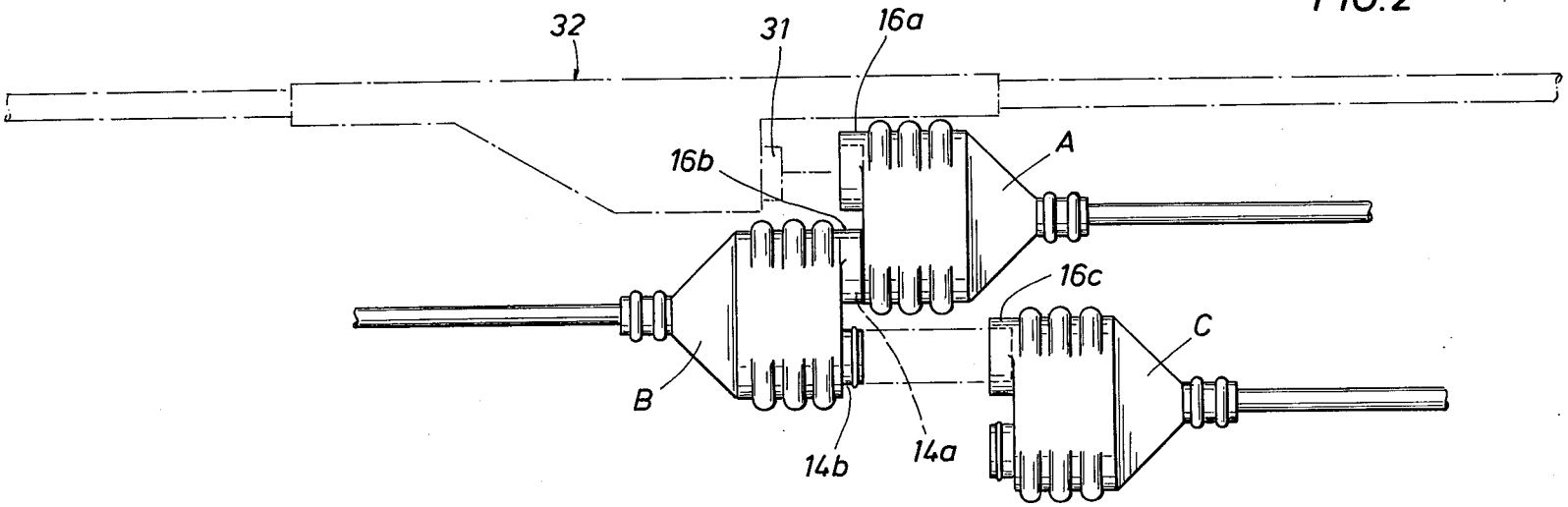
FIG. 2 is a view similar to FIG. 1 on an enlarged scale showing the main cable takeout connector in phantom lines and three takeout connectors of this invention in various assembled positions.

In FIG. 1, five such connectors are used to connect five strings of geophones, indicated by the number 34, to mainline connector 32. The last connector in the series, in this case connector E, will use dustcap 36 to cover cylindrical member **14*e*** to keep the entire assembly waterproof.

When a plurality of takeout connectors of this invention are assembled, such as the five shown in FIG. 1, they combine to provide structural integrity to the assembly. In particular, turning moments in the horizontal plane imposed on one connector is transmitted to adjacent connectors which provide additional resistance to the turning moment.

Another feature of this invention is the manner in which the conductors in takeout cable 40 are connected electrically and physically to the connector. In FIG. 5, the side of stress member 12 away from cylindrical portions 14 and 16 is shown. Electrical contacts **24*a*, 26*a*, 28*a*, and 30*a* are the portions of the male plugs and female sockets that extend through to this side of stress member 20. It is to each of these contacts that the electrical conductors in takeout cable 40 are to be electrically connected. The conductors are also connected to stress member 12** in a manner to transfer any tensile loads imposed on the takeout cable to the stress member.

Stress member 12 is provided with three lateral notches that extend in from the side of the stress member and form two spaced arms 42 and 44. Each arm is provided with a notch spaced from its outer end. The lower thicker portion of stress member 12 has groove 46 to receive one of the conductors of cable 40 in the manner to be described.

Prior to being embedded in molded elastomeric body 10, cable 40 is connected to the assembled stress member and electrical contacts. First, conductor 40*a* is inserted through opening 48 between arms 42 and 44. It is wrapped around arm 42, one or more turns as desired, in the notch provided in arm 42 then upwardly toward electrical contact 26*a*. The insulation will be stripped from the wire between arm 42 and contact 26*a*. The bare wire is then wrapped once or twice around electrical contact 26*a* and soldered thereto to provide good electrical contact. It then extends through groove 46 partially around the bottom of stress member 12 to contact 28*a* where it is wrapped once or twice and soldered to anchor it in position. Conductor 40*b* also moves through slot 48 then downwardly to arm 44 where it is wrapped around the arm once or more times in the notch provided therefor. From the arm, the conductor extends upwardly to electrical contact 24*a*. Between arm 44 and contact 24*a*, the wire is stripped of insulation and is wrapped around and soldered to contact 24*a* to provide good electrical contact. The conductor is then wrapped around and soldered to contact 30*a*.

In this manner the exposed portions of conductors 40*a* and 40*b* are maintained securely separated so that there is no danger of any short between the two conductors. The conductors are in good electrical contact with the male plugs and female sockets and the conductors are securely anchored to the stress member so that all tensile loads are transferred to the stress member.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A takeout connector for connecting a string of geophones to a main cable or to a main cable through another takeout connector comprising a body of elastomeric material having in side-by-side relationship, first and second protruding cylindrical portions, said second portion having a cavity for receiving the first cylindrical portion of another connector, means carried by one of the cylindrical portions for forming a seal with the cylindrical portion of another connector with which it is assembled, a stress member embedded in the body of elastomeric material, male plugs and female sockets mounted on the stress member with a male plug and a female socket positioned side-by-side in each of the cylindrical sections, said male plugs and female sockets being further positioned to be in common parallel planes so that the male plug and female socket in the cylindrical portion of one cylindrical portion can be electrically connected to the male plug and female socket of another takeout connector and the other male plug and female socket in the other cylindrical portion can be electrically connected to a cylindrical portion of yet another takeout connector.

2. The takeout connector of Claim 1 in which the male plugs and female sockets that extend from one side of the stress member have electrical contacts extending from the opposite side of the stress member, and in which the stress member has three notches extending laterally from a side between two pairs of electrical contacts to form two spaced arms, a two wire conductor cable embedded in the body of elastomeric material having one wire wrapped around one arm, then wrapped around one contact of the first pair on one side of the arms then to one of the contacts of the second pair with the other wire wrapped around the other arm then the other contact on said one side of the arms then along a groove in the side of the stress member to the other contact of the second pair to avoid having uninsulated wires in or close to each other.

* * * * *